United States Patent [19]

Tanabe et al.

[11] Patent Number: 4,988,919

[45] Date of Patent: Jan. 29, 1991

[54] SMALL-DIAMETER STANDING-WAVE LINEAR ACCELERATOR STRUCTURE

[75] Inventors: Eiji Tanabe, Sunnyvale; Matthew Bayer, Mountain View, both of Calif.; Mark E. Trail, Moscow, Id.

[73] Assignee: Varian Associates, Inc., Palo Alto, Calif.

[21] Appl. No.: 157,086

[22] Filed: Feb. 8, 1988

Related U.S. Application Data

[63] Continuation of Ser. No. 733,175, May 13, 1985, abandoned.

[51] Int. Cl.[5] ..... H05H 9/04

[52] U.S. Cl. ..... 315/5.410; 313/360.1; 328/233

[58] Field of Search ..... 315/5.41, 5.42; 313/360.1; 328/233; 376/108

[56] References Cited

U.S. PATENT DOCUMENTS

| | | | |
|---|---|---|---|
| 3,953,758 | 4/1976 | Tran | 315/5.41 X |
| 4,155,027 | 5/1979 | Schriber et al. | 315/5.41 |

FOREIGN PATENT DOCUMENTS

| | | | |
|---|---|---|---|
| 1081817 | 3/1984 | U.S.S.R. | 328/233 |
| 1101168 | 1/1987 | U.S.S.R. | 328/233 |

OTHER PUBLICATIONS

Knapp, 1970, "High Energy Structures", in *Accelerators*, La Postolle et al. (Eds) Wiley, pp. 601–616.

Dome, 1970, "Review and Survey of Accelerating Structures", in *Accelerators*, LaPostolle et al. (Eds), Wiley, pp. 637–659.

Taylor, 1970, "Radiofrequency Problems", in *Accelerators*, LaPostolle et al. (Eds), Wiley, pp. 905–909.

Hoffswell et al., 1983, "Higher Modes in the Coupling Cells of Coaxial and Annular-Ring Coupled Linac Structures", *IEEE Transactions on Nuclear Science*, NS-30, No. 4, pp. 3588–3589.

Knapp et al., 1968, "Standing Wave High Energy Linear Accelerator Structures", *Review of Scientific Instruments*, 39, #7, pp. 979–991.

Tran, 1977, "A Low-Cost RF-Structure for Electron and Proton Linac", in *IEEE Transactions on Nuclear Science*, NS-24, #3, pp. 1774–1775.

Hahn et al., 1968, "Perturbation Measurement of Transverse R/Q in Iris-Loaded Waveguides", in *IEEE Transactions on Microwave Theory and Techniques*, MTT-16, #1, pp. 20–29.

IEEE Trans. on Nuclear Science, vol. NS-30, No. 4, Aug., 1983, "Heat Transfer, Thermal Stress Analysis and The Dynamic Behaviour of High Power RF Structures", J. McKeown and J. P. Labrie.

Proc. of 1984 Linear Accelerator Conf. pp. 177–179, "Coaxial-Coupled Linac Structure for Low Gradient Applications", Laszewski & Hoffswell.

Nuclear Instruments and Methods in Physics Research 227 (1984), 196–204, North-Holland, Amsterdam "Caracteristiques de Dispersion et Impedances Shunt de Trois Structures Biperiodiques Acceleratrices en Bande S", Celso Fuhrmann.

"Effective Shunt Impedance Comparison Between S--Band Standing Wave Accelerators with On-Axis and Off-Axis Couplers", Schriber, Funk and Hutcheon, Atomic Energy of Canada, Ltd., Physics Div., Chalk River Nuclear Labs, Chalk River, Ontario, Canada K0J 1J0.

"The Coaxial Coupled Linac Structure", Labrie and McKeown, Accelerator Physics Branch Research Co., Chalk River Laboratories, Chalk River, Ontario, KOJIJO, Canada.

*Primary Examiner*—Benny T. Lee

*Attorney, Agent, or Firm*—Stanley Z. Cole; Sheri M. Novack; Peter J. Sgarbossa

[57] ABSTRACT

A compact, small diameter, standing-wave linear accelerator structure suitable for industrial and medical applications is disclosed. The novel structure utilizes a new type of coupling cavity for Pi/2 mode, standing-wave operation. The coupling cavity fits into the webs between the accelerating cavities substantially within the diameter of the acclerating cavities. This is made possible by keeping the center section of the cavity thin to concentrate the electric field vector at the center of a section of the cavity and by enlarging the ends of a section of the coupling cavity to accommodate the magnetic field vector. This structure offers a significant reduction in overall diameter over the side-coupled, annular ring, and existing coaxial coupled structures, while maintaining a high shunt impedance and large nearest neighbor coupling (high group velocity). A prototype 4 MeV, 36 cm long, S-band accelerator incorporating the new structure has been built and tested.

30 Claims, 4 Drawing Sheets

ON-AXIS COUPLED STRUCTURE

COAXIAL COUPLED STRUCTURE

SIDE COUPLED STRUCTURE

ANNULAR COUPLED STRUCTURE

SMALL-DIAMETER STANDING-WAVE LINEAR ACCELERATOR STRUCTURE

This application is a continuation of application Ser. No. 733,175, filed May 13, 1985, now abandoned.

FIELD OF THE INVENTION

The present invention relates generally to standing-wave linear particle beam accelerators and more particularly to charged particle beam accelerators and methods wherein a coaxial coupled structure is used to build a small-diameter efficient electron accelerator for radiation therapy and industrial radiography.

BACKGROUND OF THE INVENTION

Electron linear accelerators with energies up to 50 MeV have been widely used for radiation therapy and industrial radiography since early 1960. Currently an emphasis is being placed on more efficient, compact, and cost-effective designs. For standing-wave, Pi/2 mode linear accelerators, the coupling cavities allow for a flexibility of design, since they are unexcited in steady state operation. Existing standing-wave accelerator coupling cavities can be placed in four general design types: on-axis, coaxial, side cavity, and annular ring structures. These four structures are shown schematically in FIG. 1.

Since the side cavity structures are off-axis, they do not influence the design of the accelerating cells, enabling side coupled accelerators to attain high efficiencies. Side coupled structures, however, have the disadvantages of increasing the effective diameter of the accelerator guide and the number of machining and assembly steps required.

Cylindrically symmetric cavities, the on-axis, coaxial, and annular ring designs, have the advantage of being machined directly into the opposite side of an accelerating cell, thereby eliminating multipiece assembly and prebrazing. Construction costs can be substantially reduced. Existing designs, however, all have disadvantages. The radius of an on-axis coupling cavity is comparable to the radius of the accelerating cavity. The structure is susceptible, however, to the excitation of parasitic and beam blowup modes, which reduce the overall accelerator efficiency and beam stability. (See J. P. Labrie and J. McKeown, "The Coaxial Coupled Linac Structure", Nuclear Instruments and Methods, No. 193, pp. 437–444, 1982). On-axis structures are also sensitive to thermal detuning, a result of the thermal deformation of the web between the accelerating cells. (See: J. McKeown and J. P. Labrie, "Heat Transfer, Thermal Stress Analysis and the Dynamic Behavior of High Power RF Structures", IEEE Transactions on Nuclear Science, Vol. NS-30, No. 4, pp. 3593–3595, 1983).

Coaxial structures eliminate the direct interaction of the electron beam with the coupling cavity, but designs of the prior art increase the effective guide diameter 60% to 80%. Prior art designs consist of narrow cylindrical cavities sandwiched between accelerating cells, which operate at a coaxial $TM_{010}$-like mode. (See for example: C. Fuhrmann et al, "Characteristiques de Dispersion et Impedances Shunt de Trois Structures Biperiodiques Acceleratrices en Bande S", Nuclear Instruments and Methods in Physics Research, No. 227, pp. 196–204, 1984 and R. M. Laszewski and R. A. Hoffswell, "Coaxial-Coupled Linac Structure for Low Gradient Applications", in Proceedings of the Linear Accelerator Conference 1984, pp. 177–179). Annular ring designs in the prior art have the same size disadvantage as the existing coaxial structures, along with increased machining complexity.

SUMMARY OF THE INVENTION

A coaxial coupling cavity extends the zero field region between adjacent accelerating cavities, thereby reducing the efficiency of the accelerator. Coaxially coupled structures, however, attain a higher percentage of theoretical shunt impedance. (See: S.O. Schriber, "Accelerator Structure Development for Room-Temperature Linacs", IEEE Trans. Nuclear Science, Vol. NS-28, No. 3, pp. 3440–3444, June 1981). Consequently, accelerator efficiencies comparable to that of side coupled structures can be obtained if the web between accelerating cells is not increased more than several millimeters. The size disadvantage of the annular ring and existing coaxial designs exemplifies the problem of developing a new coaxial design which (1) has a diameter comparable to an accelerating cavity, (2) does not significantly increase the web thickness, and (3) has strong nearest neighbor coupling with small next nearest neighbor coupling. In this invention, a new coaxial cavity design is disclosed.

The newly developed coupling cavity is located entirely within the copper web between the accelerating cells of a standing wave, linear, electron accelerator operated at the Pi/2 mode. The coupling cavity is isolated from the beam axis of the accelerator. The outer radius of the coupling cavity is approximately equal to that of the accelerating cavities resonating at the same frequency, distinguishing the design from prior art coupling structures not open to direct electromagnetic interaction with the accelerated electron beam. The regions of the cavity near the inner and outer radii are enlarged to form triangular sectioned volumes, while the middle region consists of a pair of narrowly separated parallel plates. Consequently, the magnetic and electric components of the fundamental mode electromagnetic field resonating in the cavity are separated, by concentrating the magnetic field in the inductive end regions of the coupling cavity and the electric field in the capacitive region between the parallel planes.

Coupling is accomplished through a pair of coupling slots 180° apart cut into the web between the coupling and accelerating cavities. This preserves symmetry about the beam axis, minimizing the beam perturbation. Because the magnetic field in the coupling cavity is concentrated in this region and the electric field is negligible, the magnetic coupling is maximized while the electric coupling is minimized. This is an optimum coupling situation for high efficiency operation. Relatively small slots intercept sufficient flux for coupling. This minimizes the effect of coupling on the electric field distribution of the accelerating cavities. Further, by rotating the coupling slots 90° at each half accelerating cavity, the coupling slots are at maximum separation, thereby further reducing the direct coupling between accelerating cavities through the slots. This reduction increases the power flow and stability of the accelerator. Also, because the cavity is isolated from direct interaction with the beam, transverse beam break-up modes and inefficient parasitic modes cannot be excited by beam-cavity interaction.

These and further constructional and operational characteristics of the invention will be more evident from the detailed description given hereinafter with reference to the figures of the accompanying drawings which illustrate preferred embodiments and alternatives by way of non-limiting examples.

DESCRIPTION OF THE PREFERRED EMBODIMENT

Figure 1A:
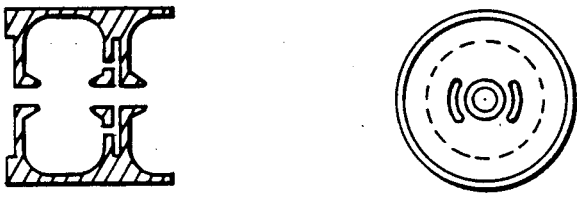
FIG.1A PRIOR ART
FIG. 1*a* on-axis coupled structure, FIG. 1*b* coaxial coupled structure, FIG. 1*c* side coupled structure, FIG. 1*d* annular coupled structure.
Figure 1B:
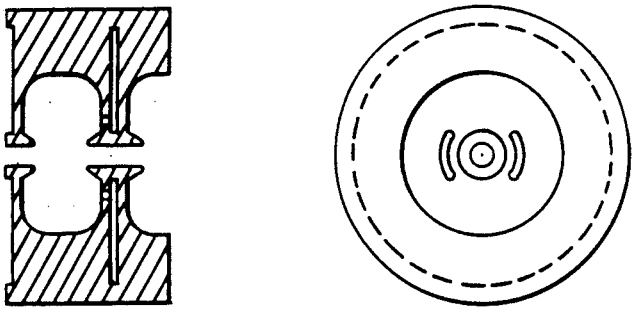
FIG.1B PRIOR ART
FIG. 1 shows partial longitudinal cross-sections and end views of four general types of designs of standing-wave linear accelerators in the prior art.
Figure 1C:
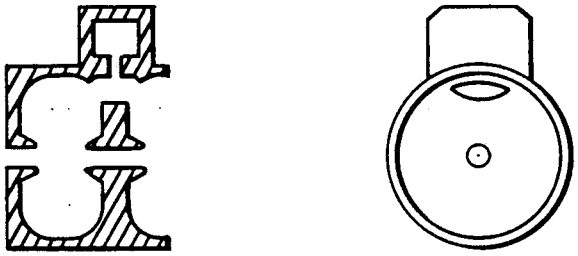
FIG.1C PRIOR ART
Figure 1D:
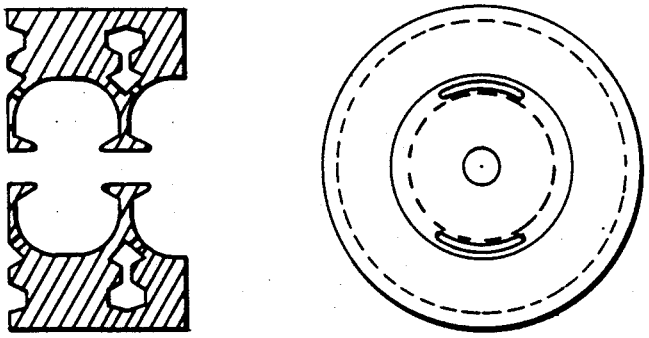
FIG.1D PRIOR ART
Figure 2B:
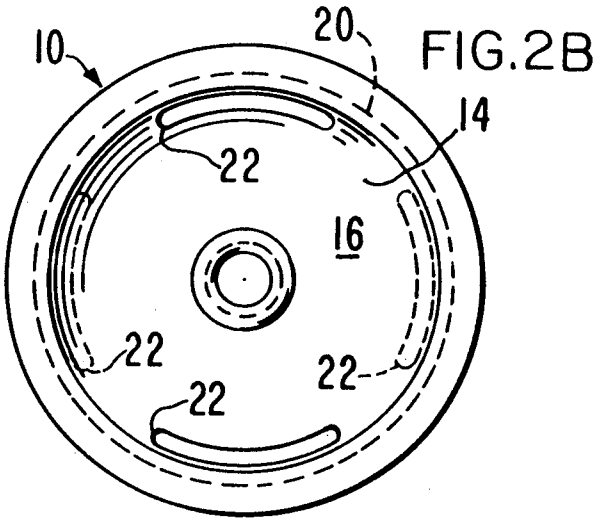
FIG. 2 shows a partial longitudinal cross-section in FIG. 2*a* and an end view in FIG. 2*b* of the sandingwave linear accelerator according to the invention.
Figure 2A:
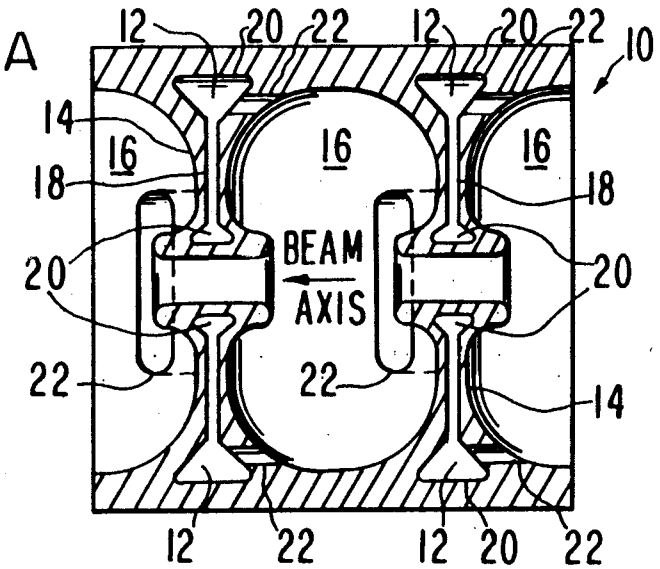
Figure 3:
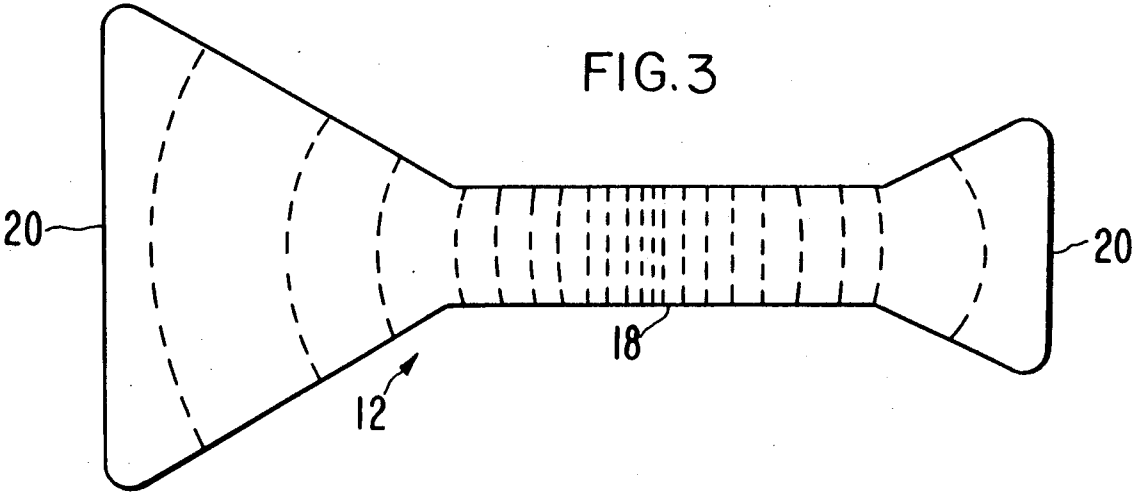
FIG. 3 shows a section through the coupling cavity according to the invention in which the dotted lines represent the electric field vector.

Referring now to the drawings wherein reference numerals are used to designate parts throughout the various figures thereof, there is shown in FIG. 2 a short section of the structure according to the invention. It consists of a small radius, coaxial structure 10 with coupling cavities 12 which are located in the webs 14 between accelerating cavities 16 and increase the magnetic induction in those regions near the inner and outer radii of the coupling cavity. In essence, the geometry enhances the intrinsic field distribution of a simple coaxial cavity in the $TM_{010}$-like mode, while reducing the cavity to smaller overall dimensions. The thin flattened regions 18 between the enlarged end regions 20 act as an effective capacitor and concentrate the electric field in the flattened regions 18 as shown in FIG. 3, away from the coupling slots 22. The concentration of the magnetic field in the enlarged regions 20 provides an ideal coupling opportunity. The shape of the enlarged regions 20 was selected to be in the triangular form shown in the drawings but other enlarged shapes can be used, such as a hemispherical or oval type shape. Two slots 22 are cut 180° opposite each other about the beam axis into each accelerating cavity 16, thereby preserving symmetry about the beam axis. Relatively small slots can provide adequate nearest neighbor coupling, $K_1$ (not shown), and the next nearest neighbor coupling, $K_2$ (not shown), can be made negligibly small by rotating the slots 22 90° about the beam axis at the opposite side of each web 14 at each cell. The design also allows for a very high $K_1$ to be obtained while keeping $K_2$ to an acceptable value, by increasing the slot width and arc length.

The coupling cavity sits in the web between two accelerating cavities. Several dimensional constraints were imposed upon the prototype design for an S-band accelerator structure. First, the coupling cavity outer diameter was to be approximately equal to a maximum diameter perpendicular to the beam axis of an accelerating cavity. Second, the parallel plate gap could not be less than 3 mm to maintain reasonable mechanical tolerances. Third, a minimum wall thickness of 3 mm for S-band cavities was to be maintained at all points for mechanical stability and thermal conduction.

Before the coupling cavity prototype was designed, an accelerating cavity with a 9 mm web thickness was optimized for maximum shunt impedance, using the cavity program LALA. (See: H. C. Hoyt et al, "Computer Designed 805 MHz Proton Linac Cavities", Review of Scientific Instruments, Vol. 37, p. 755, 1966.) A cavity with inner radius 3.58 cm and theoretical shunt impedance per unit length of 124 M-ohm/m was developed. The cavity code LACC was then used to design the coaxial cavity, subject to the constraints listed above. (See: A. Konrad, "A Linear Accelerator Cavity Code Based on the Finite Element Method", Computer Physics Communications, No. 13, pp. 349–362, 1978.) The program was used to arrive at a cavity 5% higher in frequency than the operation frequency, because of the anticipated effect of the coupling slots. The size and location of the coupling slots were determined using the LACC magnetic field values. A coupling slot 22 of arc length 45° and width 5 mm was selected and located along the outer edge of the accelerating cavity 16. Substantially smaller and larger slots are workable.

The prototype coupling cavity shown in FIG. 2 resonates at 3160 MHz without the coupling slots and 3015 MHz with the slots. In the assembled accelerator, however, the coupling slots are rotated 90° and this lowers the full cavity frequency to 3000 MHz. Machine tuning to within ±0.2 MHz of the desired frequency was easily accomplished by increasing the diameter to lower the frequency or the capacitive gap to increase the frequency.

Figure 4:
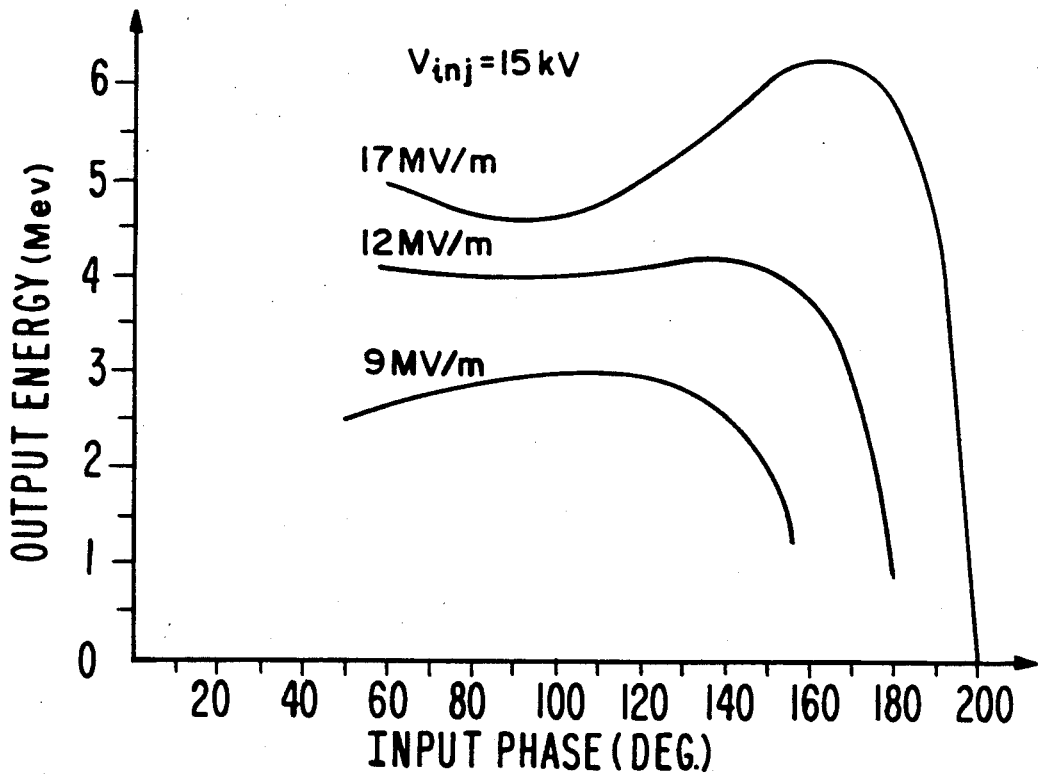
FIG. 4 shows theoretical energy spectra for the accelerator according to the invention.

The prototype accelerator was designed to match the performance characteristics or an existing side coupled structure for comparison, the L1000-A accelerator built by Varian Associates. It consists of 7½ accelerating cavities and was designed for optimum performance at 4 MeV output energy. A beam simulation program was used to develop the buncher configuration for the guide, using the LALA field profiles. An injection voltage of 15 kV was used, with variable field gradients. A three-cell buncher with cell length 44.8 mm was selected. The resulting output energy spectrums are given in FIG. 4 wherein output energy, in millions of electron volts, is plotted against input phase for field strengths of 9 megavolts/meter, 12 megavolts/meter and 17 megavolts/meter. For the 9 and 12 megavolts/meter electric field strengths, the output energy remains relatively constant over a relatively wide range of inpart phases between approximately 60° and 140°. The output energy remains at the relatively constant level for the 12 megavolts/meter field strength until the input phase increases to approximately 160°. While the performance is not as flat for the higher electric field strength of 17 megavolts/meter, there is a very substantial output energy for input phases varying between approximately 60° and 190°.

The overall length of the guide is 35.9 cm. RF power from a magnetron is inputted at the 4th full accelerating cavity. The peak of power delivered at the guide is 2.3 MW, with a 4.3 microsecond pulse width. Table I summarizes the accelerator design parameters.

TABLE I

| PERFORMANCE SUMMARY | |
|---|---|
| Accelerator Length | 35.9 cm |
| Number of Cavities | 7 ½ |
| Frequency | 2997 MHz |

TABLE I-continued

| PERFORMANCE SUMMARY | | |
|---|---|---|
| Coupling: Nearest Neighbor ($K_1$) | 3.3% | |
| Nearest Neighbor ($K_2$) | .03% | |
| RF Peak Power | 2.3 | MW |
| RF Pulsewidth | 4.3 | microsecond |
| E peak/$E_o$ | 8.1 | |
| Transit Time Factor | .916 | |
| Theoretical $Q_o$ | 16,000 | |
| Theoretical $ZT^2/L$ | 124 | M-ohm/m |

| | Design | Measured |
|---|---|---|
| $Q_o$ | 14,400 | 13,500 |
| $Q_{ext}$ | 7,200 | 6,600 |
| $Beta_o = Q_o/Q_{ext}$ | 2.0 | 2.05 |
| $ZT^2/L$ | 111 M-ohm/m | 104 M-ohm/m |

In Table I the values of $Q_o$, $Q_{ext}$, $Beta_o$ and $ZT^2/L$ have the usual values, viz: $Q_o$=unloaded quality factor of an accelerating cavity, $$\frac{1}{Q_{ext}} = \frac{1}{Q_o} + \frac{1}{Q_{beam}},$$

$$Q_{beam} = \left(\frac{\text{power dissipated in guide}}{\text{power dissipated in beam}}\right) Q_o$$

$$\frac{ZT^2}{L} = \text{effective shunt impedance per unit length,}$$

Z=accelerator shunt impedance, T=transit time factor, i.e., ratio of energy gain in presence of oscillating field to energy gain in static field.

Both the coupling and accelerating cells were accurately machined of oxygen-free high conductivity (OHFC) copper to make post-braze tuning of the guide unlikely. The accelerating cells were tuned in separate halves to within ±0.1 MHz of the desired frequency. The desired frequencies were determined from the dispersion measurements of successive stacks of 2, 4, and 6 half cells. The coupling cavities were tuned in separate halves to within ±0.2 MHz of 3009 MHz, which gave full coupling cell frequencies of approximately 2994 MHz. Because of the sensitivity of the large capacitive region of the coupling cavity to gap length, the effect of the braze had to be allowed for. The full coupling cavity frequency varies 240 MHz/mm of additional spacing between half cells. The braze process adds 20 microns of copper between cells on average, resulting in an approximately 5 MHz increase.

Figure 5:
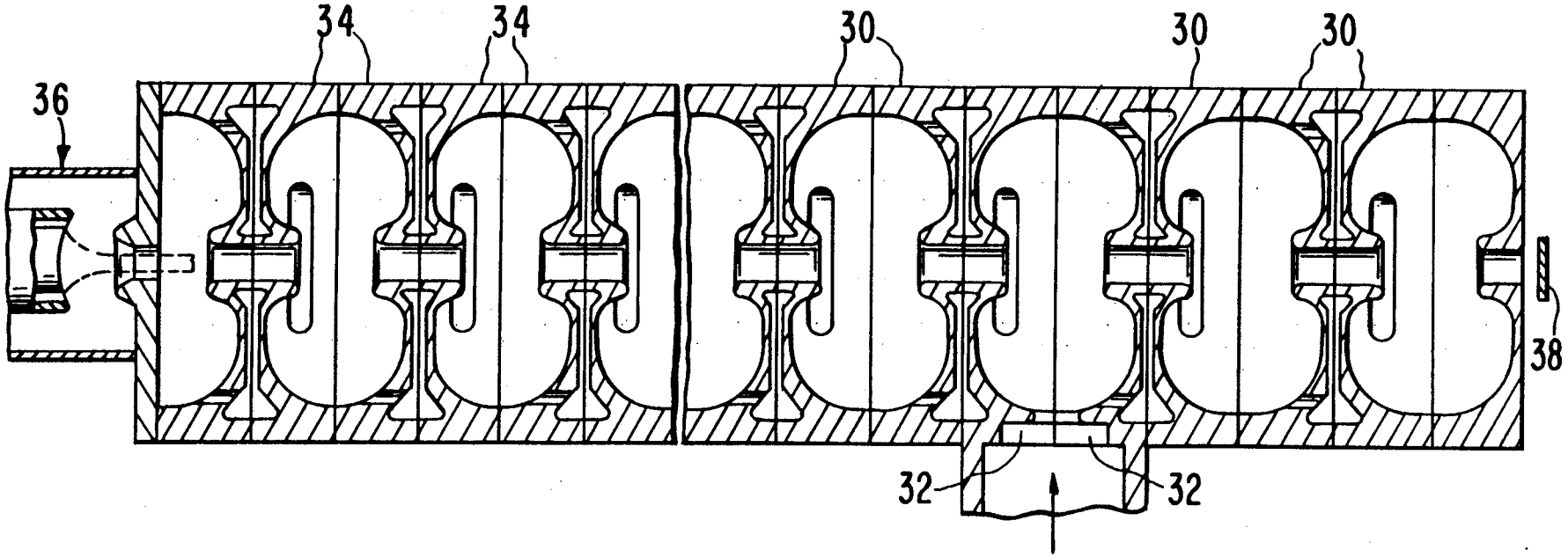
FIG. 5 shows, a longitudinal cross-section of the complete accelerator according to the invention.

The prototype accelerator constructed to test the new coupling cavity is shown in FIG. 5. A series of identical half-cavity pieces 30 of OFHC copper are brazed together alternately back to back and front to front as shown. Slightly modified coupler half cells 32 are used to admit microwave energy. Slightly shorter buncher pieces 34 are used to increase the beam velocity to match the phase of the accelerating section. A beam source 36 inserts a beam into the buncher. The high energy beam strikes a target or window 38 at the end opposite to that of the beam source.

Figure 6:
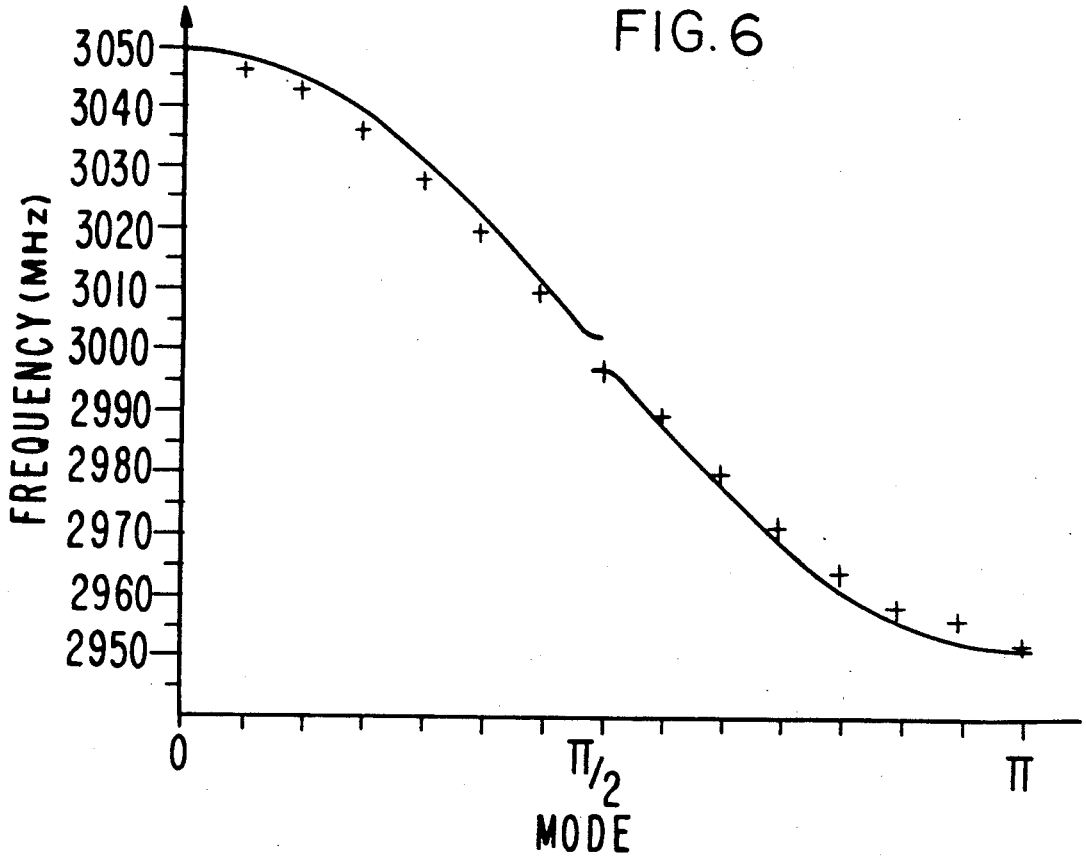
FIG. 6 shows measured and theoretical dispersion curves for the accelerator according to the invention.

The measured and theoretical dispersion curves for the brazed guide are shown in FIG. 6 wherein frequency, in megaHertz, is plotted against mode, in radians. As illustrated in FIG. 6, there is a continuous, gradual decrease in frequency as mode increases from zero through $\pi$ radians, such that at zero radians, the frequency is 3050 MHz, at the $\pi/2$ mode, frequency is approximately 2998 MHz, and at the $\pi$ mode, frequency is approximately 2956 MHz. The theoretical curve assumes a biperiodic structure with $f_{accelerating}$=2996.69 MHz and $f_{coupling}$=3001.5 MHz. The bead drop data are shown in FIG. 6. The bead drop data were derived in the usual way, i.e., by measuring the on axis electric field of the accelerator while a low power beam subsists and by measuring the on axis electric field strength while a metal bead is dropped along the beam axis on a dielectric line positioned on the axis. The bead causes a change in frequency and decrease in electric field strength. The guide had a measured $Q_o$ of 13,500 and $Q_{ext}$ of 6,580, with a VSWR ($Beta_o$) of 2.05. The nearest neighbor coupling, $K_1$ was 3.3% and the next nearest neighbor coupling was 0.04%. The coupling cavity frequencies were 3001.5 MHz, ±1.5 MHz. Before and after brazing length measurements of the guide indicated a greater than average increase per cell, approximately 30 microns. This explains the high coupling cavity frequency, which is apparent in the dispersion curve. The accelerating cells remained tuned to within ±0.1 MHz of a fixed frequency. These frequency variations were acceptable and no post-braze tuning of the guide was done.

This invention is not limited to the preferred embodiments heretofore described, to which variations and improvements may be made, without leaving the scope of protection of the present patent, the characteristics of which are summarized in the following claims.

We claim:

1. A linear standing-wave charged-particle beam accelerator for accelerating a beam of particles generated by a source, said accelerator comprising:

plural cascaded standing wave electromagnetically coupled accelerating cavities, each cavity having approximately the same resonant frequency, said accelerating cavities being positioned so that the particle beam propagates through each of the cavities, said particle beam having a longitudinal beam axis, said accelerating cavities being figures of rotation around the beam axis and having a maximum diameter perpendicular to the beam axis of an accelerating cavity, all adjacent pairs of said accelerating cavities being electromagnetically coupled together, plural coupling cavities located equidistant between said accelerating cavities to provide a portion of the electromagnetic coupling of the accelerating cavities, said coupling cavities being substantially within said maximum diameter perpendicular to the beam axis of the accelerating cavities, each of said coupling cavities being configured as a hollow flattened annular ring having an inner rim defining an inner diameter and an outer rim defining an outer diameter, said coupling cavities being coaxial with the beam axis, said flattened annulus defining a gap, said gap at a mean position of said inner and outer diameters being much less than the diameter of said outer rim with said gap significantly increased at said inner and outer rims, means for coupling said accelerating cavities to said coupling cavities to provide another portion of the electromagnetic coupling of the accelerating cavities, and said coupling cavities including means for isolating said coupling cavities from excitation by said particle beam.

2. The accelerator of claim 1 wherein said coupling means includes a first pair of slots connecting a first main cavity to a coupling cavity near said counter rim of said coupling cavity, each of said slots of the first pair being configured as an arc of a circle around said beam axis, said slots of the first pair being generally spaced 180 degrees from each other with respect to said beam axis, and a second pair of slots between said coupling cavity and a second main cavity, each of said slots of the second pair being configured as an arc of a circle around said beam axis, said slots of the second pair being generally spaced 180 degrees from each other with respect to said beam axis.

3. The accelerator of claim 2 wherein each of said slots of the second pair is spaced 90 degrees from each of said slots of the first pair with respect to said beam axis, the size of the gap at said outer rim of said coupling cavity being substantially greater than the size of the gap at said inner rim.

4. The accelerator of claim 1 wherein the gap at said outer rim of said coupling cavity is substantially increased in size over the size of the gap at said inner rim.

5. The accelerator of claim 1 wherein each of said coupling cavities is configured as a flattened annular ring, said gap having a section extending from a center portion to inner and outer diameter sectional portions of generally triangular shape.

6. The accelerator of claim 5 wherein each of said triangular shapes is configured as an isosceles triangle defining apexes between equilateral sides of said triangles, said triangular shapes being oriented so said apexes are closest to said center portion of said section of said coupling cavity.

7. The accelerator of claim 1 wherein supporting walls are provided between said accelerating cavities and coupling cavities, said walls having sufficient thickness to dissipate heat.

8. A linear accelerating structure for a particle beam of an accelerator for particles of the beam, the beam having an axis through the structure, the structure comprising plural accelerating cavities having axes substantially coincident with the beam axis, plural webs, each of said webs being between adjacent pairs of said accelerating cavities, each of said webs including a coupling cavity between the accelerating cavities adjacent thereto, the coupling cavities being field coupled with the accelerating cavities adjacent thereto and decoupled from the beam except via said adjacent coupling cavities to provide field coupling between the adjacent accelerating cavities, each of said coupling cavities extending at right angles with respect to the beam axis and being configured to have a first region proximate to the beam axis, a second region remote from the beam axis and a center region between the first and second regions and having a length, the first and second regions having lengths in the direction of the beam axis considerably in excess of the length of the center region in the direction of the beam axis, and wherein said coupling and accelerating cavities have outer wall segments extending in the direction of the beam axis, said outer wall segments of the coupling and accelerating cavities being displaced by approximately the same distance from the beam axis.

9. A linear standing-wave charged-particle beam accelerator for accelerating a beam of particles generated by a source, said accelerator comprising:

plural cascaded standing wave electromagnetically coupled accelerating cavities with approximately the same resonant frequency, said accelerating cavities being positioned so that a particle beam propagates longitudinally through each cavity which defines a beam axis, said accelerating cavities being figures of rotation around the beam axis, all adjacent pairs of said accelerating cavities being electromagnetically coupled, plural coupling cavities providing a portion of the electromagnetic coupling of the accelerating cavities, each of said cavities being coaxial with said accelerating cavities and located equidistant between said accelerating cavities, each said coupling cavity being isolated from said beam and having an inner radius and an outer radius, each said coupling cavity being configured to concentrate the magnetic field of a resonant mode of said coupling cavity in first and second regions respectively adjacent both said inner and outer radii while concentrating the electric field in a third region between the first and second regions; and means for coupling said magnetic field of said coupling cavity with the magnetic field of said accelerating cavity while imposing a minimum perturbation on the electric field of said accelerating cavity, said coupling means providing another portion of the electromagnetic coupling of the accelerating cavities and including an aperture between said accelerating cavity and said second region.

10. The system of claim 9 wherein said third region has a relatively narrow elongated cross section extending perpendicular to the beam axis, each of said first and second regions having an enlarged cross section relative to the narrow cross section of the third region.

11. A linear accelerating structure for a particle beam of an accelerator for particles of the beam, the beam having an axis through the structure, the structure comprising plural accelerating cavities having axes substantially coincident with the beam axis, plural webs, each of said webs being between adjacent pairs of said accelerating cavities, each of said webs including a coupling cavity between the accelerating cavities adjacent thereto, the coupling cavities being field coupled with the accelerating cavities adjacent thereto and decoupled from the beam except via said adjacent coupling cavities to provide field coupling between the adjacent accelerating cavities, each of said coupling cavities extending at right angles with respect to the beam axis and being configured to have a first region proximate to the beam axis, a second region remote from the beam axis and a center region between the first and second regions and having a length, the first and second regions having lengths in the direction of the beam axis considerably in excess of the length of the center region in the direction of the beam axis, and wherein the first and second regions have triangular cross sections in planes at right angles to the beam axis.

12. A linear standing-wave charged-particle beam accelerator for accelerating a beam of particles generated by a source, said accelerator comprising:

plural cascaded standing wave electromagnetically coupled accelerating cavities, each of the cavities having approximately the same resonant frequency, said accelerating cavities being positioned so that a particle beam propagating longitudinally through each cavity defines a beam axis, said accelerating cavities being figures of rotation around the beam axis and having a maximum diameter perpendicular to the beam axis of an accelerating cavity, all adjacent pairs of said accelerating cavities being electromagnetically coupled, together, plural coupling cavities located equidistant between said accelerating cavities to provide a portion of the electromagnetic coupling between the accelerating cavities, said coupling cavities having an inner diameter and an outer diameter, said inner diameter being much less than said maximum diameter in a direction perpendicular to the beam axis of the accelerating cavities, said outer diameter being approximately the same as to said maximum diameter perpendicular to the beam axis of an accelerating cavity, each said coupling cavity being a hollow flattened annular ring having an inner rim defining said inner diameter and an outer rim defining said outer diameter, said coupling cavities being coaxial with the beam axis, said flattened annulus defining a gap, said gap at a mean position of said inner and outer diameters being much less than the diameter of said outer rim, the gap at said inner and outer rim having a size considerably greater than the size of the gap at the mean of said inner and outer diameters, and means for coupling said accelerating cavities to said coupling cavities to provide another portion of the electromagnetic coupling of the accelerating cavities, said coupling cavity including means for isolating said coupling cavity from excitation by said particle beam.

13. A linear standing-wave charged-particle beam accelerator having an axis for the beam, comprising plural electromagnetically coupled accelerating cavities having: a common axis coincident with said beam axis, an outer wall having a predetermined maximum separation from the beam axis relative to said beam axis of said accelerating cavities, and plural coupling cavities electromagnetically coupled with said accelerating cavities; said coupling cavities being disposed in webs between said accelerating cavities, each of said coupling cavities being configured as an annular ring having a center coincident with the beam axis, an inner diameter and an outer diameter; the outer diameter being substantially within the predetermined maximum separation of the outer wall from the beam axis, the annular ring including a gap, the gap having a size substantially greater at said inner and said outer diameters than the size of the gap between said inner and outer diameters.

14. A linear accelerator comprising a source of a particle beam having an axis, an accelerating structure for the beam including: plural accelerating cavities having axes substantially coincident with the beam axis, plural webs, each of said webs separating adjacent pairs of said accelerating cavities, each of said webs including a coupling cavity formed substantially, therein between the accelerating cavities adjacent thereto, the coupling cavities being field coupled with the accelerating cavities adjacent thereto and decoupled from the beam except via said adjacent coupling cavities to provide field coupling between the adjacent accelerating cavities, each of said coupling cavities extending at right angles with respect to the beam axis and being configured to have a first region proximate to the beam axis, a second region remote from the beam axis and a center region between the first and second regions and having a length, the first and second regions having lengths in the direction of the beam axis considerably in excess of the length of the center region in the direction of the beam axis.

15. The linear accelerator of claim 14 wherein said center region and said first and second regions each include a width perpendicular to the beam axis, the width of the center region being greater than the width of each of the first and second regions.

16. A linear accelerator comprising a source of a particle beam having an axis, an accelerating structure for the beam including: plural accelerating cavities having axes substantially coincident with the beam axis, plural webs, each of said webs being between adjacent pairs of said accelerating cavities, each of said webs including a coupling cavity between the accelerating cavities adjacent thereto, the coupling cavities being field coupled with the accelerating cavities adjacent thereto and decoupled from the beam except via said adjacent coupling cavities to provide field coupling between the adjacent accelerating cavities, each of said coupling cavities extending at right angles with respect to the beam axis and being configured to have a first region proximate to the beam axis, a second region remote from the beam axis and a center region between the first and second regions and having a length, the first and second regions having lengths in the direction of the beam axis considerably in excess of the length of the center region in the direction of the beam axis, and wherein the field coupling between the adjacent accelerating cavities is provided via apertures between the second region and an outer portion of the adjacent accelerating cavities.

17. The linear accelerator of claim 16 wherein the first and second regions have triangular cross sections in planes at right angles to the beam axis.

18. The linear accelerator of claim 17 wherein each of the coupling cavities includes first and second pairs of diametrically opposed apertures, the apertures of the first and second pairs being respectively coupled with first and second ones of said adjacent cavities, the apertures of the first pair being spaced 90° from the apertures of the second pair.

19. The linear accelerator of claim 18 wherein each of said apertures is configured as a slot formed in a plane perpendicular to the direction of the beam axis.

20. A linear accelerator comprising a source of a particle beam having an axis, an accelerating structure for the beam including: plural accelerating cavities having axes substantially coincident with the beam axis, plural webs, each of said webs being between adjacent pairs of said accelerating cavities, each of said webs including a coupling cavity between the accelerating cavities adjacent thereto, the coupling cavities being field coupled with the accelerating cavities adjacent thereto and decoupled from the beam except via said adjacent coupling cavities to provide field coupling between the adjacent accelerating cavities, each of said coupling cavities extending at right angles with respect to the beam axis and being configured to have a first region proximate to the beam axis, a second region remote from the beam axis and a center region between the first and second regions and having a length, the first and second regions having lengths in the direction of the beam axis considerably in excess of the length of the center region in the direction of the beam axis, and wherein the first and second regions have triangular cross sections in planes at right angles to the beam axis.

21. A linear accelerator comprising a source of a particle beam having an axis, an accelerating structure for the beam including: plural accelerating cavities having axes substantially coincident with the beam axis, plural webs, each of said webs being between adjacent pairs of said accelerating cavities, each of said webs including a coupling cavity between the accelerating cavities adjacent thereto, the coupling cavities being field coupled with the accelerating cavities adjacent thereto and decoupled from the beam except via said adjacent coupling cavities to provide field coupling between the adjacent accelerating cavities, each of said coupling cavities extending at right angles with respect to the beam axis and being configured to have a first region proximate to the beam axis, a second region remote from the beam axis and a center region between the first and second regions and having a length, the first and second regions having lengths in the direction of the beam axis considerably in excess of the length of the center region in the direction of the beam axis, and wherein each of the coupling cavities includes first and second pairs of diametrically opposed apertures, the apertures of the first and second pairs being respectively coupled with first and second ones of said adjacent cavities, the apertures of the first pair being spaced 90° from the apertures of the second pair.

22. The linear accelerator of claim 21 wherein each of said apertures is configured as a slot formed in a plane perpendicular to the direction of the beam axis.

23. A linear accelerator comprising a source of a particle beam having an axis, an accelerating structure for the beam including: plural accelerating cavities having axes substantially coincident with the beam axis, plural webs, each of said webs being between adjacent pairs of said accelerating cavities, each of said webs including a coupling cavity between the accelerating cavities adjacent thereto, the coupling cavities being field coupled with the accelerating cavities adjacent thereto and decoupled from the beam except via said adjacent coupling cavities to provide field coupling between the adjacent accelerating cavities, each of said coupling cavities extending at right angles with respect to the beam axis and being configured to have a first region proximate to the beam axis, a second region remote from the beam axis and a center region between the first and second regions and having a length, the first and second regions having lengths in the direction of the beam axis considerably in excess of the length of the center region in the direction of the beam axis, and wherein said coupling and accelerating cavities have outer wall segments extending in the direction of the beam axis, said outer wall segments of the coupling and accelerating cavities being displaced by approximately the same distance from the beam axis.

24. A linear accelerating structure for a particle beam of an accelerator for particles of the beam, the beam having an axis through the structure, the structure comprising plural accelerating cavities having axes substantially coincident with the beam axis plural webs each of said webs separating adjacent pairs of said accelerating cavities, each of said webs including a coupling cavity formed substantially therein between the accelerating cavities adjacent thereto, the coupling cavities being field coupled with the accelerating cavities adjacent thereto and decoupled from the beam except via said adjacent coupling cavities to provide field coupling between the adjacent accelerating cavities, each of said coupling cavities extending at right angles with respect to the beam axis and being configured to have a first region proximate to the beam axis, a second region remote from the beam axis and a center region between the first and second regions and having a length, the first and second regions having lengths in the direction of the beam axis considerably in excess of the length of the center region in the direction of the beam axis.

25. A linear accelerating structure for a particle beam of an accelerator for particles of the beam, the beam having an axis through the structure, the structure comprising plural accelerating cavities having axes substantially coincident with the beam axis, plural webs, each of said webs being between adjacent pairs of said accelerating cavities, each of said webs including a coupling cavity between the accelerating cavities adjacent thereto, the coupling cavities being field coupled with the accelerating cavities adjacent thereto and decoupled from the beam except via said adjacent coupling cavities to provide field coupling between the adjacent accelerating cavities, each of said coupling cavities extending at right angles with respect to the beam axis and being configured to have a first region proximate to the beam axis, a second region remote from the beam axis, and a center region between the first and second regions and having a length, the first and second regions having lengths in the direction of the beam axis considerably in excess of the length of the center region in the direction of the beam axis, and wherein the field coupling between the adjacent accelerating cavities is provided via apertures between the second region and an outer portion of the adjacent accelerating cavities.

26. The linear accelerating structure of claim 25 wherein the first and second regions have triangular cross sections in planes at right angles to the beam axis.

27. The linear accelerating structure of claim 26 wherein each of the coupling cavities includes first and second pairs of diametrically opposed apertures, the apertures of the first and second pairs being respectively coupled with first and second ones of said adjacent cavities, the apertures of the first pair being spaced 90° from the apertures of the second pair.

28. The linear accelerating structure of claim 27 wherein each of said apertures is configured as a slot formed in a plane perpendicular to the direction of the beam axis.

29. A linear accelerating structure for a particle beam of an accelerator for particles of the beam, the beam having an axis through the structure, the structure comprising plural accelerating cavities having axes substantially coincident with the beam axis, plural webs, each of said webs being between adjacent pairs of said accelerating cavities, each of said webs including a coupling cavity between the accelerating cavities adjacent thereto, the coupling cavities being field coupled with the accelerating cavities adjacent thereto and decoupled from the beam except via said adjacent coupling cavities to provide field coupling between the adjacent accelerating cavities, each of said coupling cavities extending at right angles with respect to the beam axis and being configured to have a first region proximate to the beam axis, a second region remote from the beam axis and a center region between the first and second regions and having a length, the first and second regions having lengths in the direction of the beam axis considerably in excess of the length of the center region in the direction of the beam axis, and wherein each of the coupling cavities includes first and second pairs of diametrically opposed apertures, the apertures of the first and second pairs being respectively coupled with first and second ones of said adjacent cavities, the apertures of the first pair being spaced 90° from the apertures of the second pair.

30. The linear accelerating structure of claim 29, wherein each of said apertures is configured as a slot formed in a plane perpendicular to the direction of the beam axis.

* * * * *